United States Patent [19]

Oh et al.

[11] Patent Number: 4,972,609

[45] Date of Patent: Nov. 27, 1990

[54] PROTECTIVE SHOE APPARATUS

[75] Inventors: Thomas J. Oh, Saratoga, Calif.; Sam S. Yoon; Sa H. Chong, both of Knoxville, Tenn.

[73] Assignee: Pioneer Interstate, Inc., San Carlos, Calif.

[21] Appl. No.: 443,504

[22] Filed: Nov. 30, 1989

[51] Int. Cl.[5] ..... A41D 17/00; A41D 17/14; A43B 5/00

[52] U.S. Cl. ..... 36/2.00 R; 36/50; 36/114

[58] Field of Search ..... 36/113, 114, 50, 89, 36/2 R

[56] References Cited

U.S. PATENT DOCUMENTS

| | | | |
|---|---|---|---|
| 3,769,722 | 11/1973 | Rhee | 36/2 R |
| 3,949,493 | 4/1976 | Rhee | 36/2 R |
| 4,411,077 | 10/1983 | Slavitt | 36/114 X |
| 4,523,394 | 6/1985 | Lindh et al. | 36/114 X |

*Primary Examiner*—Paul T. Sewell
*Assistant Examiner*—Ted Kavanaugh
*Attorney, Agent, or Firm*—Flehr, Hohbach, Test, Albritton & Herbert

[57] ABSTRACT

A protective shoe is disclosed herein for use in the martial arts. The shoe provides a protective shoe upper and an elastic strap which is wrapped partially around the foot to snugly secure the shoe to the foot.

6 Claims, 3 Drawing Sheets

PROTECTIVE SHOE APPARATUS

The present invention relates generally to a protective shoe. More particularly, the present invention relates to an improved means for securing a protective, martial arts shoe to the foot.

BACKGROUND OF THE INVENTION

The martial arts, such as karate, kung fu and the like, are oriental disciplines of self defense. Martial artists rely on a repertoire of punches and kicks to strike and cripple an adversary. Students of the martial arts are required to spend significant amounts of time in training. The kicking and punching motions must be repetitiously practiced to obtain the accuracy, force and bodily coordination required to become proficient in the art.

A standard martial art training technique is for two students to practice their punches and kicks in a sparring match. Both sparring partners, however, are at risk of becoming injured. Repeated kicks to the sparring partner can result in the severe bruising of the foot. Alternatively, the recipient of an errant kick can be severely injured.

To reduce the chance of injury, a number of protective martial art training shoes are available. These shoes are generally made of energy-absorbing materials and are designed to soften the force of impact of the foot. See, for example, Hunderford in U.S. Pat. No. 3,667,140 and Rhee in U.S. Pat. No. 3,949,493.

Rhee in U.S. Pat. No. 3,769,722 discloses a protective shoe for the martial arts. The shoe comprises a continuous one piece outer casing which covers the top portion of the foot. Two straps are used to secure the shoe to the foot. One end of each strap is attached to the top of the casing. The other end of each strap is wrapped completely around the entire casing and the bottom of the foot. The second ends of both straps are secured to the top of the casing to securely hold the foot within the casing.

Several safety problems and inconveniences exist with the Rhee shoe. The area of the casing where the straps are attached is often a kick contact point, which means the rough surface of the straps often comes into contact with the recipient of the kick. The rough surface of the straps can cause irritation and punctures to the skin. Secondly, without a shoe tongue in the casing, exit and entry from the casing is difficult because the opening into which the foot is inserted can not be expanded. Lastly, the use of two straps as opposed to one to secure the shoe casing to the foot is time consuming.

Referring now to FIG. 1, a perspective view of another prior art protective shoe is shown. The protective shoe 10 includes a unitary casing 12 having a shoe tongue 14, a back 16, a first side 17 and a second side 18, and a substantially open sole 19 (not shown). A single elastic strap 20, fastened to the back 16 of the casing 12 is used to securely fasten the protective shoe to the foot.

Referring now to FIGS. 2 and 3, two sequential drawings are provided to illustrate an intermediate and a final stage, respectively, of strap 20 being completely wrapped around shoe upper 12 and the foot. In FIG. 2, the first end of the strap 20 is shown attached to the shoe back 16. Strap 20 is then stretched along first side 17 of the casing, crossed over tongue 14, down second side 18, passed underneath the sole 19, and is returned to first side 17 of the casing. In FIG. 3, strap 20 is criss-crossed over the tongue 14 and completely wrapped around the foot. The first and second ends of strap 20 are attached to one another at shoe back 16 by a hook and loop fabric fastener (not shown).

Several problems exist with the prior art as set forth above with respect to FIGS. 1 through 3. It is inconvenient for the martial artist to wrap and unwrap the elastic strap each time shoe 10 is put on or taken off. Additionally, since the elastic band is wrapped completely around the foot, blood circulation may be restricted to the foot if the strap is pulled too tightly. This may impede the performance of the martial artist as well as cause circulation related injuries to the foot.

SUMMARY OF THE INVENTION

Accordingly, it is an object of the present invention to provide a protective martial arts shoe which is easy to insert and remove from the foot.

Another object of the invention is to provide an improved means to snugly secure a protective martial arts shoe to the foot with an elastic strap which is partially wrapped around the shoe and which does not completely encircle the foot.

The present invention provides a martial arts shoe which includes a shoe upper with a back, a tongue, first and second sides forming the shoe upper and a substantially open bottom. The tongue includes a first and second openings extending through the tongue. An elongated elastic strap having a first and a second end is used to secure the shoe to the foot. The first end of the strap is affixed to the back of the shoe upper. The second end of the strap is threaded from the back of the shoe, along the first side of the shoe upper, from above the tongue and through the first opening extending through the tongue, across the open bottom of the shoe upper, along the second side of the shoe upper and from beneath the tongue through the second opening extending through the tongue. To secure the shoe to the foot, the second end of the strap is affixed to the back of the shoe upper. In this manner, the elastic strap securely holds the protective shoe to the foot without completely encircling the foot.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENT

Figure 1:
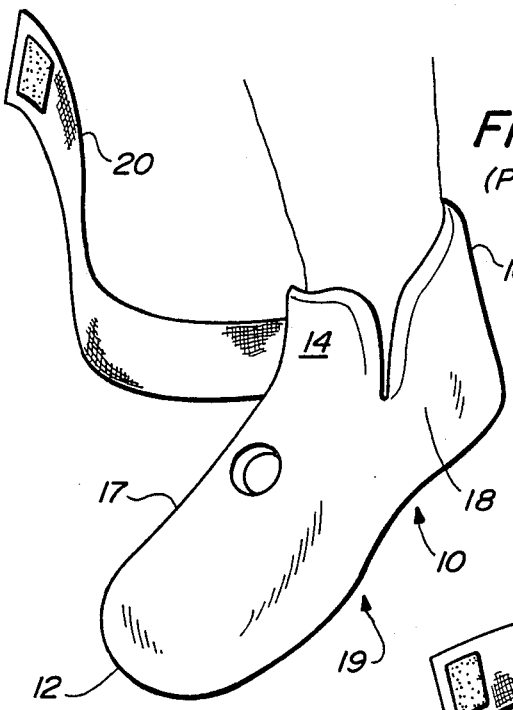
FIG. 1 (PRIOR ART)
FIG. 1 is a perspective view of a protective shoe for use in the martial arts according to the prior art.
Figure 2:
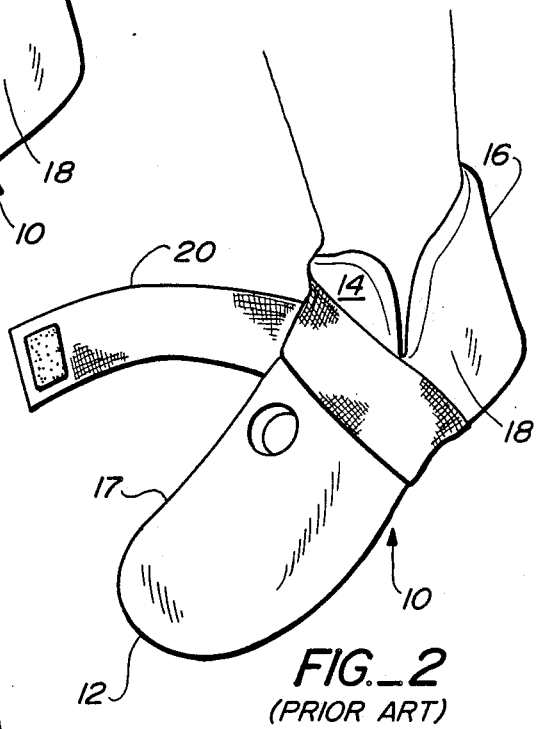
FIG. 2 (PRIOR ART)
FIG. 2 is an intermediate sequential view illustrating an elastic band in the process of being wrapped completely around the shoe of FIG. 1 to secure the shoe to the foot according to the prior art.
Figure 3:
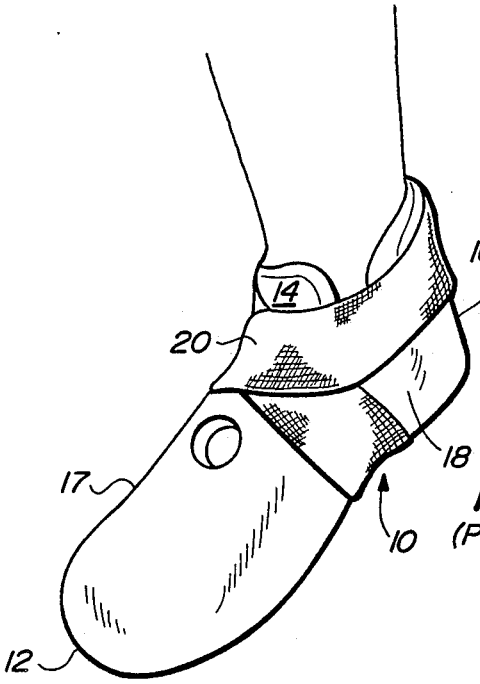
FIG. 3 (PRIOR ART)
FIG. 3 is a final sequential view showing the elastic band being completely wrapped around the shoe of FIG. 2 according to the prior art.
Figure 4:
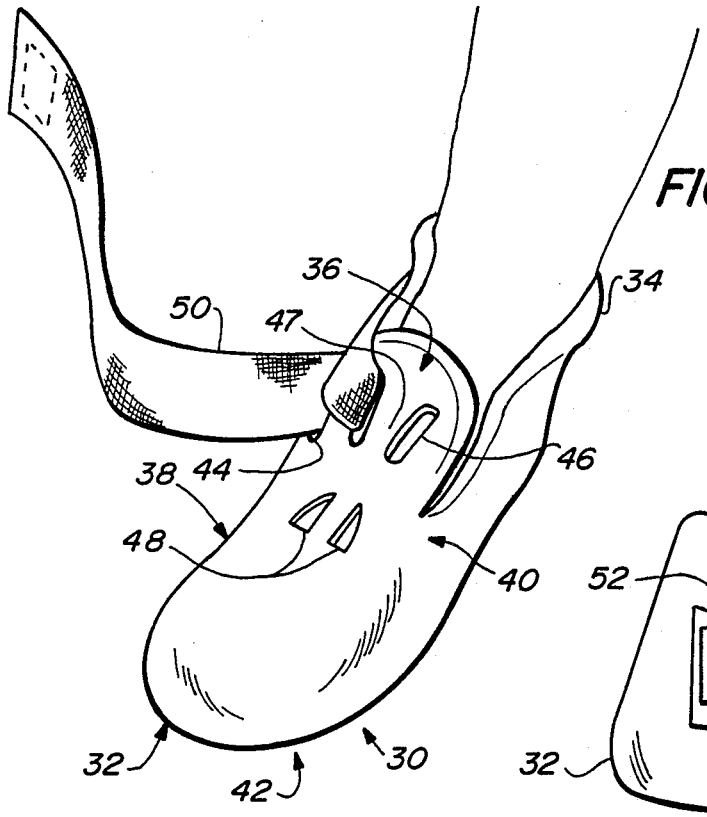
FIG. 4 is a perspective view of the protective martial art shoe according to the present invention.

Referring to FIG. 4, there is shown a perspective view of the protective martial art shoe according to the present invention. The shoe 30 includes a shoe upper 32 with a back 34, a tongue 36, first side 38 and second side 40 forming the shoe upper. The bottom 42 (not shown) of the shoe upper 32 is substantially open to expose the sole of the foot. The tongue 36 includes a first opening 44 and a second opening 46 extending through the tongue. Openings 44 and 46 are two parallel slits separated by a central section 47 of the tongue 36. Air vents 48 perforating the top surface of the shoe upper 32 permit air to circulate inside the shoe upper. The shoe 30 is generally made of a resilient, energy absorbing material, such as a resilient plastic foam covered with a smooth, tough, flexible, vinyl coating, both of which are conventional for such shoes.

Figure 5:
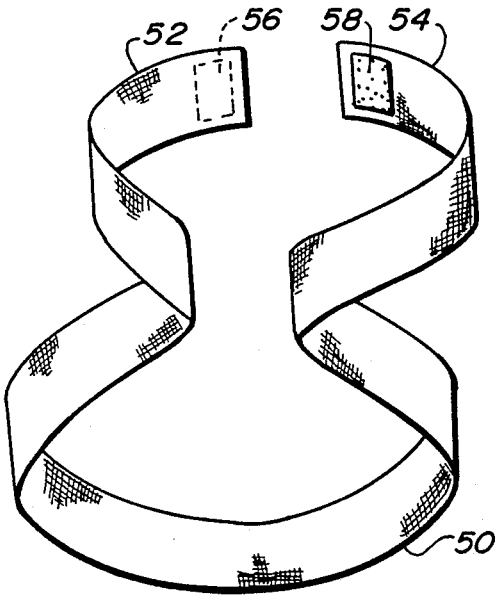
FIG. 5 is an elastic strap which is used to partially wrap around the shoe of FIG. 4 to snugly secure the shoe to the foot.

Referring now to FIG. 5, an elastic strap 50 which is used to partially wrap around the shoe of FIG. 4 to snugly secure the shoe to the foot is shown. The strap includes a first end 52 and a second end 54. The end 52 includes an area 56 covered with a fabric loop fastener, and the other end 54 is includes an area 58 covered with a fabric hook fastener. As is described in detail below, to secure the shoe to the foot, the strap 50 is partially wrapped around the shoe so as not to completely encircle the foot in such a way that ends 52 and 54 meet at shoe back 34 and are then fastened together by the hook and loop fastener.

Figure 6:
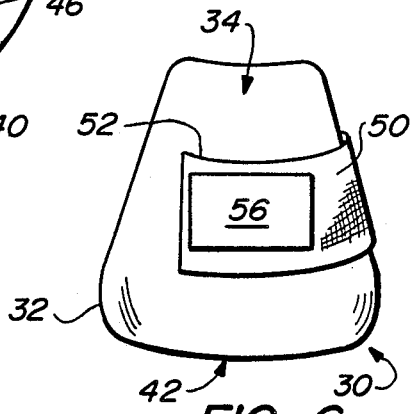
FIG. 6 is a back view of the shoe shown in FIG. 4 showing one end of the elastic strap of FIG. 5 being affixed to the back of the shoe.

Referring now to FIG. 6, a back view of the shoe of FIG. 4 is shown. First end 52 of the elastic strap is affixed to the back 34 of the shoe upper. By way of example, glue or a similar adhesive means may be used to secure the strap to the back 34 of the shoe 30. However, it would be obvious to one skilled in the art to use other fastening means, such as sewing strap end 52 to the back 34.

Figure 9:
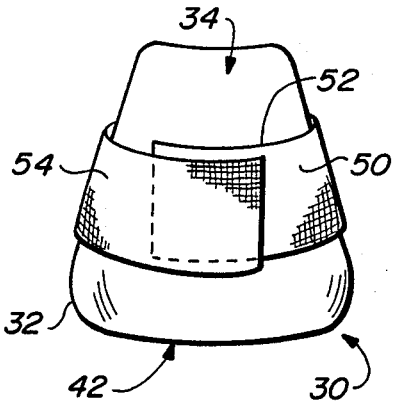
FIG. 9 is a back view of the shoe shown in FIG. 4 with the two ends of the elastic strap adjoined together at the back of the shoe according to the present invention.
Figure 7:
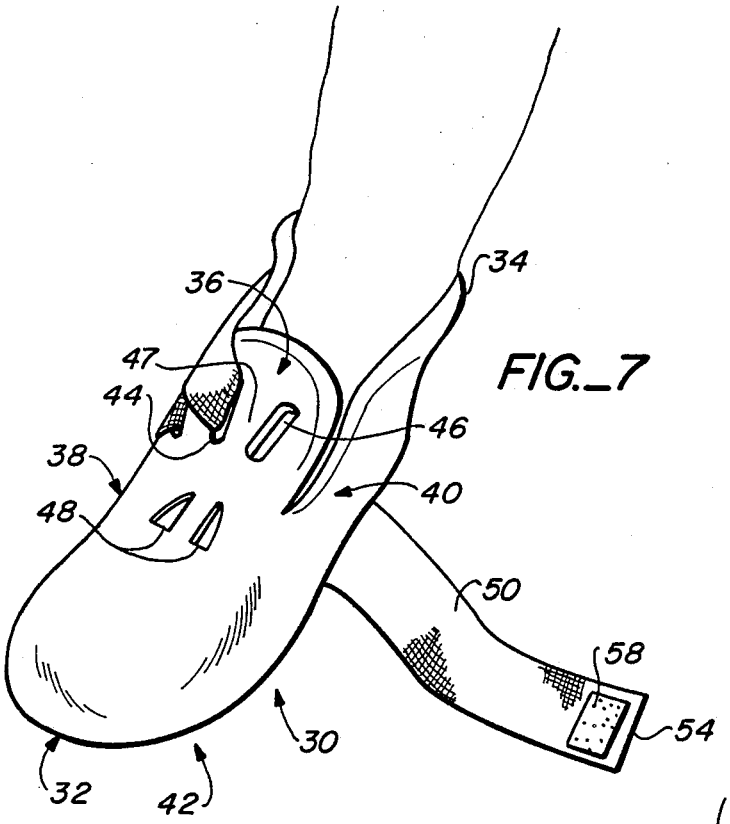
FIG. 7 is the same perspective view of the martial arts shoe of FIG. 4 with the elastic strap of FIG. 5 being in an initial stage of being partially wrapped around the shoe according to the present invention.
Figure 8:
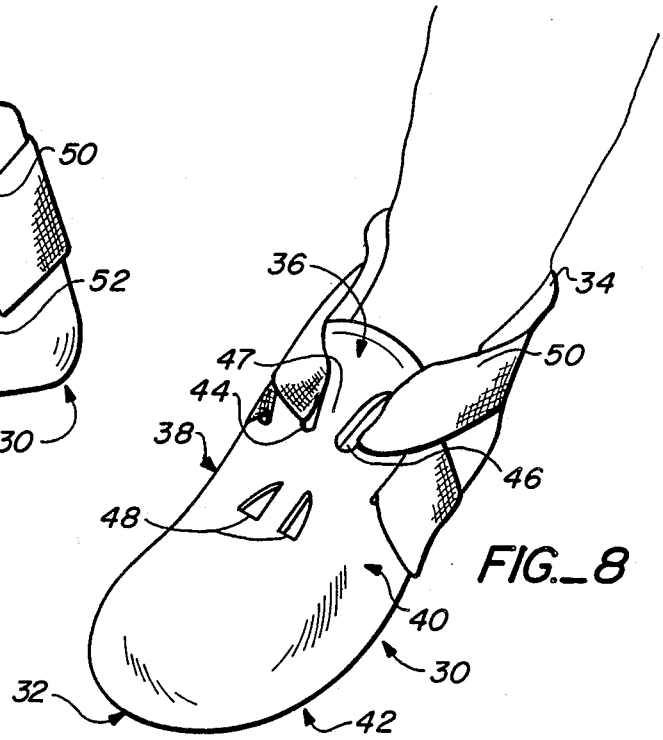
FIG. 8 is the same perspective view of the martial arts shoe of FIG. 7 with the elastic strap being in an intermediate stage of being partially wrapped around the shoe according to the present invention.

Referring now to FIGS. 7 through 9, a sequential series of drawings are provided to illustrate the initial, intermediate and final stages respectively of the strap 50 being partially wrapped around the shoe upper to snugly secure the shoe to the foot. First, the foot must be comfortably slipped into shoe 30. Thereafter, as best shown in FIG. 7, second end 54 of elastic strap 50 is initially extended from shoe back 34 along the first side 38 of the shoe upper. End 54 is then threaded from above the tongue 36 through first opening 44 extending through the tongue.

As best shown in FIG. 8, strap 50 is then extended across the open bottom 42 of the shoe upper 32. Referring now to FIG. 9, the elastic strap 50 is shown in its final stage for snugly securing shoe 30 to the foot without strap 50 completely wrapping around the foot. Strap 50 is stretched up the second side 40 of the shoe upper and from beneath the tongue 36 through second opening 46 extending through the tongue. The second end 54 of the strap 50 is stretched and affixed to the shoe back 34. Cross member 47 is therefore not encircled by strap 50.

In alternative methods for partially wrapping the strap 50 around the shoe upper, second end 54 of strap 50 is threaded from beneath tongue 36 and up through first opening 44 extending through the tongue. The remainder of the partial wrapping is then carried out as described above. Similarly, second end 54 may be passed down from above tongue 36 through the second opening 46 extending through the tongue. Otherwise, the partial wrapping is carried out as in the initial description. As a third alternative, the two alternatives could be used together, with the remainder of the partial wrapping carried out as in the initial description. In these three embodiments, the elastic strap 30 securely holds the protective shoe to the foot without completely encircling the foot, as in the initial embodiment.

Referring now to FIG. 9, a back view of shoe 30 is shown. Two ends 52 and 54 of elastic strap 50 are adjoined together at shoe back 34 by the hook and loop fastener as described above. The tension caused by the elastic recovery properties of strap 50 acts to snugly secure shoe 30 to the foot.

Once the strap has been laced the first time, it is not necessary to re-thread the strap 50 through the two tongue openings as described above. To remove shoe 30, the hook and loop fastener coupling first end 52 and second end 54 of strap 50 are separated. The slack in the tension caused by the release of the two ends enables the foot to be readily slipped out of the shoe. The strap is thus left in an intermediate position to that shown in FIGS. 7 and 8. To use the shoe again, the foot simply has to be slipped back into the shoe and the strap's second end 54 must be re-fastened to first end 52 with the hook and loop fastener at shoe back 34.

Figure 10:
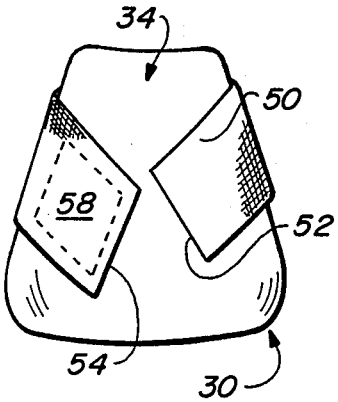
FIG. 10 is a back view of the shoe shown in FIG. 4 according to an alternative embodiment for securing the elastic strap to the back of the shoe according to the present invention.

Referring now to FIG. 10, a back view of the shoe of FIG. 4 an alternative embodiment for securing the elastic strap to shoe back 34 is shown. First end 52 of the strap is affixed to first side 17 of shoe back 34 at an angle. The second strap end 54, after being wrapped partially around shoe upper 30 and the foot as described above, is affixed to second side 18 of shoe back 34 at an angle. To secure second strap end 54 to shoe back 34 a fabric loop fastener is provided on the second side of shoe back 34.

While the present invention has been described with reference to a few specific embodiments, the description is illustrative of the invention and is not to be construed as limiting the invention. Various modifications may occur to those using this invention without departing from the true spirit and scope of the invention as defined by the appended claims.

What is claimed is:

1. A martial arts shoe, comprising:

a shoe upper with a back, a tongue, first and second sides forming the shoe upper and an open bottom;

first and second openings extending through the tongue;

an elongated elastic strap having a first and a second end;

the first end of the strap being affixed to the back of the shoe upper;

the second end of the strap being threaded from the shoe back, along the first side of the shoe upper, beneath the tongue and through the first opening extending through the tongue, across the open bottom of the shoe upper, along the second side of the shoe upper and from beneath the tongue through the second opening extending through the tongue; and the second end of the strap being affixed to the back of the shoe upper, whereby the elastic strap securely holds the protective shoe to the foot without completely encircling the foot.

2. The improved shoe fastener of claim 1, wherein the first and second openings in the tongue are elongated slits through the tongue.

3. The improved shoe fastener of claim 1, wherein said first and second tongue recess openings are parallel with one another.

4. The improved shoe fastener of claim 1, wherein said first and second openings in the tongue are separated by a central portion of the tongue.

5. The improved shoe fastener of claim 1, wherein the first end and second end of the elastic strap are affixed together by a hook and loop fabric fastener at the back of the shoe upper.

6. A martial arts shoe, comprising:

a shoe upper with a back, a tongue, first and second sides forming the shoe upper and an open bottom;

first and second openings extending through the tongue;

an elongated elastic strap having a first and a second end;

the first end of the strap being affixed to the back of the shoe upper;

the second end of the strap being threaded from the shoe back, along the first side of the shoe upper, through the first opening extending through the tongue, across the open bottom of the shoe upper, along the second side of the shoe upper and through the second opening extending through the tongue; and the second end of the strap being affixed to the back of the shoe upper, whereby the elastic strap securely holds the protective shoe to the foot without completely encircling the foot.

* * * * *